United States Patent [19]
Voigt, Jr. et al.
[11] 4,325,759
[45] Apr. 20, 1982

[54] PREPARATION OF TNT-THERMOPLASTIC POLYMER GRANULES READILY SOLUBLE IN A TNT MELT

[75] Inventors: H. William Voigt, Jr., Wharton; Bernard R. Banker, Mine Hill, both of N.J.

[73] Assignee: The United States of America as represented by the Secretary of the Army, Washington, D.C.

[21] Appl. No.: 104,499

[22] Filed: Dec. 17, 1979

[51] Int. Cl.[3] ..... C06B 45/10
[52] U.S. Cl. ..... 149/19.92; 149/105; 149/109.6
[58] Field of Search ..... 149/19.4, 18, 19.92, 149/105, 109.6

[56] References Cited

U.S. PATENT DOCUMENTS

| | | | |
|---|---|---|---|
| 3,447,980 | 6/1969 | Voigt | 149/105 |
| 3,706,609 | 12/1972 | Voigt et al. | 149/105 |
| 3,754,061 | 8/1973 | Forrest et al. | 149/105 |
| 3,884,735 | 5/1975 | Cramer | 149/105 |
| 4,012,245 | 3/1977 | Voigt et al. | 149/105 |

*Primary Examiner*—Edward A. Miller
*Attorney, Agent, or Firm*—Nathan Edelberg; Robert P. Gibson; A. Victor Erkkila

[57] ABSTRACT

A process is provided for preparing a composition composed of TNT and a thermoplastic organic polymer containing as high as 30–35% of the polymer, in the form of a granular product, which is rapidly soluble in a TNT melt. The process involves preparing a solution of the TNT and the polymer in methyl ethyl ketone solvent and diluting the solution with water to precipitate the TNT-polymer composition as granules, which can be readily separated by filtration and are rapidly soluble in molten TNT.

20 Claims, No Drawings

PREPARATION OF TNT-THERMOPLASTIC POLYMER GRANULES READILY SOLUBLE IN A TNT MELT

GOVERNMENTAL INTEREST

The invention described herein may be manufactured, used and licensed by the Government for Governmental purposes without the payment to us of any royalties thereon.

BACKGROUND OF THE INVENTION AND PRIOR ART STATEMENT

Explosive compositions containing technical grade 2,4,6-trinitrotoluene (TNT) are often cast into artillery shells, rockets, bombs, etc. by heating the composition to melt the TNT and then pouring the melt into the shell where it is allowed to cool and solidify. Cast charges thus obtained usually exhibit undesirable properties, such as exudation of oily impurities on storage, voids, poor compressive strength, brittleness, lack of homogeneity due to oriented crystal structure of the TNT, etc., which adversely affect ballistic performance and impact sensitivity. Various methods have been proposed to overcome such undesirable properties, but they have been only partially successful. For example, British Pat. No. 1,249,038 discloses that a fine crystalline cast charge of TNT having random crystal structure can be obtained by incorporating a small amount of hexanitrostilbene into the moltem composition. However, the hexanitrostilbene is not effective for overcoming other deficiencies of cast TNT compositions, such as brittleness, exudation, etc. Generally, it has been necessary to employ a combination of different additives to treat the various difficiencies of cast TNT compositions, and the methods used and the results obtained often have not been entirely satisfactory. Additives used in this manner include nitrocellulose and other cellulose esters, e.g. cellulose propionate, natural and synthetic resins, such as waxes, polyurethane resins, epoxy resins, and polyethylene and polypropylene resins.

Recently it has been discovered that the manifold problems and deficiencies associated with cast TNT explosive compositions can be substantially reduced or eliminated by the incorporation of a single, broad spectrum additive consisting of a thermoplastic polyurethane elastomer, which is dissolved in the TNT melt. The method is more fully described in U.S. patent application Ser. No. 66,598, filed 14 Aug. 1979 entitled "Castable TNT Compositions Containing a Broad Spectrum Preformed Thermoplastic Polyurethane Elastomer Additive", H. William Voight, Jr., inventor, which is a continuation application of prior application Ser. No. 885,716, filed 13 Mar. 1978, now abandoned. As noted therein, the thermoplastic polyurethane elastomer additive provides, inter alia, fine random crystallinity of the TNT, reduces exudation, renders the cast TNT stronger, less brittle and more resistant to cracks at low temperatures, permits the cast composition to be remelted and resolidified for reuse without loss of homogeneity and explosive properties and requires no special conditions to exclude the presence of moisture during the melting and casting of the explosive compositions.

The aforementioned application discloses the incorporation of a preferred thermoplastic polymethane elastomer, Estane 5702 (manufactured by the B.F. Goodrich Co. and believed to be the reaction product of 4,4'-diphenylmethane diisocyanate, poly (tetramethyleneadipate) glycol and 1,4-butanediol) in a TNT-based castable explosive composition to produce a modified Composition B explosive consisting of 59.5 parts RDX, 0.5 part Estane 5702 and 40 parts TNT. Estane 5702 and other thermoplastic polyurethane elastomer additives generally dissolve slowly with difficulty in molten TNT in which they have limited solubility. The present method for dissolving the elastomer additive in a TNT melt comprises precoating the elastomer on the crystalline RDX particles by precipitating the elastomer from a solution thereof in an organic solvent, which spreads the elastomer over a large surface and thereby increases the rate of solution of the elastomer in the molten TNT. However, even when thus coated or mixed with the RDX particles, the elastomer dissolves rather slowly in molten TNT, requiring several hours to effect complete solution. Also the method of coating the elastomer on the RDX particles is not entirely satisfactory, since it entails a number of operations, which increase the cost of manufacture and limit the capacity for producing the cast shell filler, which is particularly serious in times of emergency.

To alleviate this problem, an attempt has been made to prepare a concentrate consisting of TNT and the elastomer, e.g. about 2 parts TNT and 1 part Estane 5702, which could be incorporated directly in molten TNT and perhaps dissolve more rapidly therein due to the substitution of soluble TNT in place of RDX, which is essentially insoluble in molten TNT. The method involved dissolving the mixture of TNT and Estane in acetone and evaporating the solvent solution to dryness. Such attempts were unsuccessful, since the product was obtained in the form of a hard, gritty product which dissolved slowly in molten TNT.

SUMMARY AND DETAILED DESCRIPTION OF THE INVENTION

In accordance with the present invention there is provided a simple and efficient process for producing a concentrate consisting essentially of TNT and a thermoplastic organic polymer, such as Estane, in the form of granules, which dissolve rapidly in molten TNT.

The process of the present invention comprises dissolving a mixture of TNT and the thermoplastic organic polymer, such as Estane 5702, in a water-soluble organic solvent in which the TNT and the polymer are soluble, and precipitating the mixture from the solution by dilution with water. In a preferred embodiment of the present process, the solution is diluted with a relatively large amount of water, preferably at least about five parts by volume of water per part of the organic solvent, with vigorous agitation, whereby the TNT-polymer concentrate is precipitated in the form of granules, which can be readily separated from the liquor by filtration and dissolve quickly in molten TNT. For optimum results the dilution water is employed in an amount which is sufficient to dissolve the solvent substantially completely. Advantageously, a small amount, e.g. 0.01% to about 1%, of a dispersing agent or protective colloid, such as gum arabic, arabinogalactan, and sodium dodecylbenzensulfonate is added to the dilution water, since it has a beneficial effect on the uniformity and solubility rate in molten TNT of the granules of concentrate produced.

Solvents which can be employed in the process of the present invention comprise saturated aliphatic ketones containing 3 to 5 carbon atoms, including acetone, methyl ethyl ketone (MEK), diethyl ketone and methyl isopropylketone. Acetone and methyl ethyl ketone are the preferred solvents because of their low cost, availability and excellent performance and results in the present process. The solvents can be employed singly or in mixtures thereof.

The reason for the advantageous physical and solubility properties of the concentrate obtained by the process of the present invention is not fully understood. However, it is believed that these properties can be explained at least partially by our discovery that the TNT product, produced by aqueous precipitation from solvent solution according to the process of the present invention, is obtained in the form of an impalpable powder of relatively low bulk density indicative of a relatively large surface area. This was demonstrated by the following experiment, wherein a solution of 4 grams of TNT in 15 ml of MEK, warmed to 38° C., was added slowly to 75 ml of cold (12° C.) water being subjected to vigorous agitation. The precipitated TNT was separated by filtration, washed with two 50 ml portions of cold water and dried, yielding an impalpable powder of low bulk density. Therefore, it is believed that when the TNT-polymer concentrate is precipitated from MEK solution with water, the polymer and TNT are obtained as an extremely intimate mixture of extremely finely divided particles of relatively low bulk density, so that when the concentrate is added to a TNT it presents a much greater interface area, which greatly increases the rate of solution of both the TNT and the polymer in the molten TNT.

The TNT-polymer concentrate composition preferably contains about from 10 to 25 weight percent of the thermoplastic polymer and about 75 to 90 weight percent TNT, although amounts up to about 30–35% polymer can be employed with acceptable results. However, as the amount of polymer, particularly a thermoplastic elastomer such as Estane, in the concentrate is increased above about 30–35%, the physical characteristics of the product obtained by precipitation in water are adversely affected in that the precipitate becomes chunky and difficult to filter, and is less readily soluble in molten TNT. Since it is desirable to include as much of the polymer in the concentrate as is consistent with acceptable solubility and other physical characteristics of the concentrate, the inclusion of less than 10% polymer is less preferred, although ratios as low as 1% polymer and 99% TNT can be satisfactorily employed.

In place of Estane noted above, any thermoplastic organic polymer which is soluble in the organic solvent utilized can be employed with similar results in the present process. For economic reasons the polymer employed preferably has a solubility of at least 5 parts per 100 parts by weight of the solvent to minimize the amount of solvent required as well as the volume of dilution water and cost of solent recovery. Also, the thermoplastic polymer should be at least slightly soluble in TNT, since generally at least about one part by weight of the polymer per 1000 parts of TNT must be dissolved in the TNT to be effective in modifying the TNT in the final cast TNT explosive composition, although up to 50 parts or more of the polymer per 1000 parts of TNT can be employed. Suitable thermoplastic organic polymers include polyurethanes, cellulose esters and ethers, such as nitrocellulose and cellulose propionate, polyvinyl resins such as polyvinyl nitrate and polyvinyl acetate, and phenoxy resins. The thermoplastic polymers can be employed singly or in mixtures thereof. Thermoplastic polyurethane elastomers are particularly effective for improving a wide range of properties of cast TNT explosive compositions as disclosed in aforementioned U.S. patent application Ser. No. 66,598, filed 14 Aug. 1979, and are hence preferred. Such polyurethanes include reaction products of organic polyisocyanates, e.g. toluene diisocyanate and 4,4'-diphenylmethane diisocyanate, with long chain polyether or polyester diols, such as poly (tetramethyleneadipate) glycol and poly (caprolactone) col, and optionally in conjunction with short chain diols, such as 1,4-butanediol. Thermoplastic polyurethane elastomers described in U.S. Pat. No. 2,871,218 are particularly desirable for preparing the TNT-polymer compositions of the present invention.

The following examples serve to illustrate specific embodiments of the method of carrying out the process of the present invention and set forth the best mode contemplated by the inventors for carrying out the invention but are not to be construed as limiting the invention in any manner.

EXAMPLE 1

100 grams of Estane 5702 were mixed with 1500 ml of methyl ethyl ketone (2-butanone) and the mixture was allowed to stand overnight and then agitated to completely dissolve the Estane. 400 grams of flaked TNT were added to the resulting solution and the mixture was agitated until the TNT was completely dissolved. The solution thus obtained was poured into 7500 ml of vigorously agitated, cold (15° C.) water, which contained 2.5 g of dissolved STRactan-2 powder consisting of 98% arabinogalactan and marketed by the St. Regis Paper Co., New York. The 20/80 Estane-TNT concentrate was thereby precipitated as uniform granules which were readily separated by filtration. The filter cake was washed twice with 2 liter portions of cold water and dried at 70° C. maximum air temperature.

The product thus obtained was in the form of uniform, free-flowing granules having a bulk density of 0.234 g/ml. When 2.5 g of the product was added to 38 g of molten TNT agitated and maintained at 85° C., it dissolved completely within 2 minutes.

EXAMPLE 2

The procedure of example 1 was repeated except that the STRactan-2 dispersing agent was omitted. The uniform Estane-TNT granules thus obtained, when added to molten TNT as above, dissolved completely in 5 minutes.

EXAMPLE 3

The procedure of example 1 was repeated except that 3000 ml of MEK and 15000 ml of dilution water were employed. The uniform free-flowing Estane-TNT granules thus obtained dissolved completely in 2 minutes when added to molten TNT as above.

EXAMPLE 4

The procedure of example 2 was repeated except that 300 g of TNT rather than 400 g TNT were used. The 25/75 Estane-TNT product was obtained in somewhat irregular granules which dissolved completely in 9 minutes when added to molten TNT in the foregoing manner.

EXAMPLE 5

The procedure of example 4 was repeated except that an equal volume of acetone was employed as the solvent in place of MEK. The 25/75 Estane-TNT product was obtained as irregular granules, which required 14 minutes to dissolve completely when added to molten TNT as described above.

EXAMPLE 6

The procedure of example 1 was repeated except that an equal volume of acetone was employed in place of methyl ethyl ketone. A granular 20/80 Estane-TNT product having similar rapid dissolution in molten TNT was obtained.

When the foregoing procedure was repeated except that a mixture of 100 grams of Estane 5702 and 200 grams of TNT were dissolved in 600 grams of acetone and the resulting solution was added to 1000 ml of water, a soft, chunky precipitate of 33/67 Estane-TNT concentrate was obtained which was difficult to filter and required 30 minutes to completely dissolve in molten TNT.

EXAMPLE 7

The Estane-TNT concentrate prepared according to the present invention was employed to produce a modified Composition B (which normally consists of a mixture of 60% RDX, 40% TNT) as follows:

2.5 g of the 20/80 Estane-TNT granules obtained in example 1 were added to an agitated, molten mixture of 59.5 g of RDX and 38 g of TNT maintained at 85° C. The granules were completely dissolved almost instantly, producing a modified Composition B consisting of 59.5% RDX, 40% TNT and 0.5% Estane 5702.

EXAMPLE 8

The procedure of example 1 was repeated except that instead of Estane 5702 there was employed an equal weight of a thermoplastic phenoxy resin based on a copolymer of bisphenol A and epichlorohydrin having the following molecular structure:

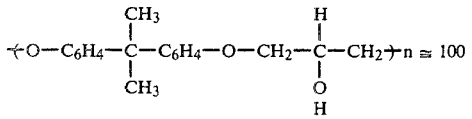

and marketed under the name Bakelite® Phenoxy Resin PKHJ by the Union Carbide Platics Co., Div. of Union Carbide Corp. The product was obtained in the form of uniform granules of similar bulk density and rapid dissolution in molten TNT.

The phenoxy resin-TNT concentrate thus prepared was employed to produce a modified Composition B as described in example 7 with similar results. (The phenoxy resin is also effective for greatly reducing the TNT 'growth' (permanent volume expansion) of cast TNT explosives and imparts exceptional toughness, rigidity, dimensional stability and low mold shrinkage thereto.)

Similar results were obtained when nitrocellulose was employed as the thermoplastic resin in analogous manner.

The foregoing disclosure is merely illustrative of the principles of this invention and is not to be interpreted in a limiting sense. We wish it to be understood that we do not desire to be limited to the exact details of construction shown and described because obvious modifications will occur to a person skilled in the art.

We claim:

1. A process for preparing a composition essentially of 2,4,6-trinitrotoluene (TNT) and a thermoplastic organic polymer containing up to about 35% of said polymer, in the form of granules rapidly soluble in molten TNT, which comprises preparing a solution of the TNT and the polymer in a water-soluble organic solvent consisting essentially of at least one saturated aliphatic ketone containing 3 to 5 carbon atoms, and diluting the solution with water in amount sufficient to precipitate the TNT-polymer composition in granular form.

2. A process according to claim 1, wherein the water is employed in a volume ratio of about five parts or more of water per part of the solvent.

3. A process according to claim 1, wherein the composition contains about from 10% to 25% of the polymer and about from 75% to 90% of TNT.

4. A process according to claim 1, wherein the polymer is selected from the group consisting of thermoplastic polyurethane resins, phenoxy resins and nitrocellulose.

5. A process according to claim 1, wherein the polymer is a thermoplastic polyurethane elastomer.

6. A process according to claim 5, wherein the elastomer is the reaction product of a long chain polyether diol or polyester diol and 2,4-toluene diisocyanate or 4,4'-diphenylmethane diisocyanate.

7. A process according to claim 5, wherein the elastomer is the reaction product of a. a hydroxy terminated polyester of a saturated aliphatic glycol of from 4 to 10 carbon atoms and a dicarboxylic acid of the formula HOOC—R—COOH, wherein R is an alkylene radical of 2 to 8 carbon atoms, b. a saturated aliphatic glycol of from 4 to 10 carbon atoms, and c. a diphenylmethane diisocyanate.

8. A process according to claim 7 wherein the elastomer is the reaction product of poly (tetramethyleneadipate) glycol, 1,4-butanediol and 4,4'-diphenylmethane diisocyanate.

9. A process according to claim 1, 3, 5 or 8 wherein the solvent is acetone.

10. A process according to claim 1, 3, 5 or 8 wherein the solvent is methyl ethyl ketone.

11. A process according to claim 1, wherein the water contains a dispersing agent or a protective colloid.

12. A process according to claim 11, wherein the dispersing agent is arabinogalactan or gun arabic.

13. A process for preparing a solution of a thermoplastic polymer in TNT, which comprises:

dissolving a mixture of the thermoplastic polymer and TNT containing up to about 35% of said polymer in a water-soluble organic solvent consisting essentially of at least one saturated aliphatic ketone containing 3 to 5 carbon atoms, diluting the solution with water in amount sufficient to precipitate the TNT-polymer mixture in granular form, and dissolving the TNT-polymer granules in molten TNT.

14. A process according to claim 13, wherein the solvent is acetone.

15. A process according to claim 13, wherein the solvent is methyl ethyl ketone.

16. A process according to claim 13, 14 or 15, wherein the polymer is selected from the group consisting of thermoplastic polyurethane resins, phenoxy resins and nitrocellulose.

17. A process according to claim 13, 14 or 15, wherein the polymer is a thermoplastic polyurethane elastomer.

18. A process according to claim 17, wherein the elastomer is the reaction product of a long chain polyether diol or polyester diol and 2,4-toluene diisocyanate or 4,4'-diphenylmethane diisocyanate.

19. A process according to claim 18, wherein the elastomer is the reaction product of a. a hydroxy terminated polyester of a saturated aliphatic glycol of from 4 to 10 carbon atoms and a dicarboxylic acid of the formula HOOC—R—COOH, wherein R is an alkylene radical of 2 to 8 carbon atoms, b. a saturated aliphatic glycol of from 4 to 10 carbon atoms, and c. a diphenyl methane diisocyanate.

20. A process according to claim 19, wherein the elastomer is the reaction product of poly (tetramethyleneadipate) glycol, 1,4-butanediol and 4,4'-diphenylmethane diisocyanate.

* * * * *